US005906542A

United States Patent [19]

Neumann

[11] Patent Number: 5,906,542

[45] Date of Patent: May 25, 1999

[54] AMUSEMENT APPARATUS

[75] Inventor: Martin Mark Neumann, Greater Manchester, United Kingdom

[73] Assignee: Rapidville Limited, London, United Kingdom

[21] Appl. No.: 08/765,637

[22] PCT Filed: Jun. 27, 1995

[86] PCT No.: PCT/GB95/01508

§ 371 Date: Dec. 30, 1996

§ 102(e) Date: Dec. 30, 1996

[87] PCT Pub. No.: WO96/00602

PCT Pub. Date: Jan. 11, 1996

[30] Foreign Application Priority Data

Jun. 30, 1994 [GB] United Kingdom ..... 9413203

[51] Int. Cl.[6] ..... F41J 5/00

[52] U.S. Cl. ..... 463/52

[58] Field of Search ..... 273/442; 463/49, 463/50, 51, 52, 53, 54, 55, 56, 57; 446/4, 6; 434/21, 22

[56] References Cited

U.S. PATENT DOCUMENTS

| | | | |
|---|---|---|---|
| 4,487,583 | 12/1984 | Brucker | 463/52 |
| 4,586,715 | 5/1986 | Scolari et al. . | |
| 4,898,362 | 2/1990 | Lamanna . | |
| 5,127,658 | 7/1992 | Openiano . | |

FOREIGN PATENT DOCUMENTS

| | | | |
|---|---|---|---|
| 0139521 | 5/1985 | European Pat. Off. . | |
| 2032072 | 4/1980 | United Kingdom | 434/21 |

*Primary Examiner*—William H. Grieb
*Attorney, Agent, or Firm*—Sughrue, Mion, Zinn, Macpeak & Seas, PLLC

[57] ABSTRACT

Amusement apparatus of the laser target game type comprises a vehicle (10) adapted for control by a game player. The vehicle has seats (16, 18) for carrying game players. A signal source (24) such as a laser or other device is under the control of a game player. Detectors (32) are carried on the vehicle for detecting signals emitted from the signal source under control of a competing game player.

6 Claims, 1 Drawing Sheet

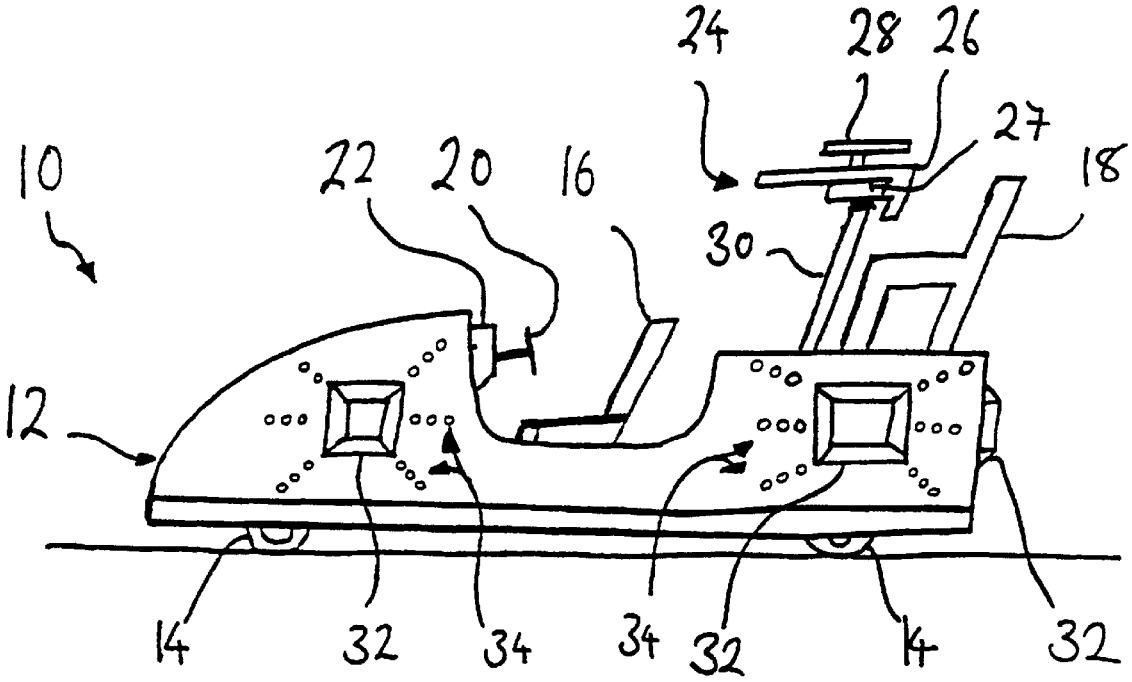
10
12
14
16
18
20
22
24
26
27
28
30
32
34
34
32
14
32

AMUSEMENT APPARATUS

BACKGROUND OF THE INVENTION

The present invention relates to amusement apparatus.

A range of games have become popular in recent times in which a player is equipped with a handset which contains a source of laser light (or other signal generating means). The handset is normally shaped as a gun and the laser is activated by a gun-like trigger. Each player is also equipped with detectors, typically mounted on his or her back and chest, which contain apparatus to detect laser light emitted from another player's gun. The game is played by a number of players in an arena and a player scores points by striking another player's detectors with laser light from his or her gun. Such games will be referred to herein as "laser target games".

The standard technology used for the various laser target games, is that of infra-red detectors and sources. The guns emitting an infra-red beam and a harmless, visible laser beam for aesthetic purposes.

Despite their enormous popularity, laser target games rely, at least partly, on novelty for their appeal, and it is inevitable that the popularity of such games will eventually wane.

SUMMARY OF THE INVENTION

It is an aim of the present invention to provide amusement apparatus which allows players to play a game which has at least some of the appealing features of laser target games and which further has new aspects to maintain the interest of players who have played laser target games in the past.

According to a first aspect of the invention there is provided amusement apparatus comprising a vehicle adapted for control by a game player, a signal source carried on the vehicle adapted for control by a game player, and detection means carried on the vehicle and operative to detect a signal emitted by a signal source of a competing player.

Most typically, the signal will comprise a laser beam. Thus, the invention enhances the known laser target games by providing the additional challenge and novelty of vehicle control. The signal may have a visible laser component and an infra-red component, the detection means being an infra-red detector. The signal source may be mounted on the vehicle under directional control of the player or is carried by a player riding on the vehicle.

The vehicle may be self-propelled, for example, it may be electrically powered by batteries carried by the vehicle.

Each vehicle may be adapted to carry more than one player. Preferably, the vehicle is arranged for control by a first player and to carry a second player to operate the signal source. This arrangement ensures that each player can give full concentration to his or her particular task, and may be safer than operation by one player.

Preferably, the laser light of the signal is emitted, at least partially, as visible light. The players may thereby see directly the results of their operation of the laser source. Such apparatus may be used in an arena which is suitably darkened and, if required, containing artificial smoke to enhance the visibility of the laser beam. Additionally, the vehicle may be illuminated externally, by lights or by luminous coatings or luminous objects fixed thereto.

The apparatus may further comprise signal detection means adapted to be carried on the body of a player.

The vehicle may be operative to react to detection of a signal emitted by a signal source under the control of a competing player in various ways. For example, motive power to the vehicle may be reduced or removed, or the signal source may be rendered temporarily inoperative. The vehicle may additionally comprise apparatus for causing a part of the vehicle to vibrate such as may be felt by players carried thereon, apparatus to generate noise (for example, a simulated explosion), or apparatus to generate light visible externally of the vehicle, each being activated on detection of a signal emitted from another player's signal source. These arrangements provide physical feedback to players in confirmation of a successful "hit" on a vehicle.

Preferably, the detection means is not responsive to signals directed from a region close to a straight-ahead axis of the vehicle's normal direction of travel. This has the particular advantage of discouraging a player from directing their vehicle head-on towards a competitor's vehicle.

Each vehicle preferably has data processing means operative to process data relating to detection of signals originating from another player's signal source and to control operation of the vehicle and of other parts of the apparatus.

In a typical arrangement, being a second aspect of the invention, there is provided an amusement installation comprising a game playing arena containing a plurality of vehicles according to the first aspect of the invention. The arena preferably contains obstacles and/or pathways about which the vehicle may be directed by a player.

The installation may additionally comprise signal source and detection apparatus substantially as provided in conventional laser target games, or fixed signal sources, in order that additional players not provided with a vehicle may take part in play.

There is preferably provided computing means operative to receive and process data from data processing means carried on each vehicle.

There may be provided communication means operative to allow remote verbal communication between players of the game.

BRIEF DESCRIPTION OF THE DRAWINGS

An embodiment of the invention will now be described in detail, by way of example, with reference to the accompanying drawing in which the sole FIGURE shows a vehicle constituting amusement apparatus embodying the present invention.

DETAILED DESCRIPTION OF THE INVENTION

With reference to the drawing, amusement apparatus comprises a wheeled vehicle 10.

The vehicle 10 comprises a body 12 carried on wheels 14 and coated in luminous paint. On the body 12 are mounted front and rear seats 16,18 facing in a forward direction of the vehicle 10. On each seat 16,18, there may be carried a player. A safety harness (not shown) is provided for each seat 16,18 to secure a player carried thereon.

A set of vehicle controls is provided forward of the front seat 16. The controls comprise a steering wheel 20 for controlling the direction of travel of the vehicle, and foot pedals (not shown) for controlling vehicle speed. Additionally, a console 22 is mounted forward of the front seat 16 on which is carried a plurality of information display devices visible by a player occupying the front seat 16. Information concerning the condition of the vehicle and the present state of play in the game may be presented to the player by the information display devices.

Forward of the rear seat 18 there is mounted a laser source 24, which may be controlled by a player occupying the rear seat 18. The laser source comprises a body portion 26 shaped to resemble a gun and carries a trigger 27 by which a player may activate it. A sight 28 may be mounted on the body portion to assist aiming of the laser beam. The laser beam is always directed in the direction the body portion is pointed. The laser source is carried on a support 30 mounted on the vehicle body 12. The laser source 24 is mounted such that it may be pivoted horizontally and vertically with respect to the support 30. The laser source 24 may be connected to the support 30, for example, by a spring.

A plurality of detectors 32 are mounted externally on the vehicle body 12. Each laser detector is operative to detect laser light such as that emitted from the laser source 24 carried on a similar vehicle. The detectors 32 are arranged to detect laser light arriving from a direction to a side or to the rear of the vehicle 10, but not generally forward of the vehicle 10.

Various apparatus to generate light visible externally of the vehicle 10 is further provided. Such apparatus may comprise a plurality of light-emitting diodes or small light bulbs 34 arranged in an aesthetically pleasing pattern on the vehicle body 12. Additionally, there is carried on the vehicle sound generating apparatus to generate a sound audible to players on the vehicle 10 and vibration generating apparatus operative to generate vibrations which may be felt by players sitting in the seats 16,18.

The vehicle additionally comprises electric propulsion motors. Such motors may be powered by batteries carried on the vehicle or, alternatively, may receive power from external source as with a conventional "dodgem car" type amusement vehicle.

Additionally, and not shown, the vehicle 10 comprises data processing means by which operation of its various components is controlled.

In a typical Installation, there is provided an arena containing a plurality of substantially identical vehicles 10. The arena comprises a floor surface over which the vehicles may travel. The floor surface may be divided, for example, by obstacles around which the vehicles 10 must be guided or pathways along which the vehicles 10 may pass. Additionally, the installation comprises computing means, which conveniently may comprise a personal computer, adapted to communicate with the data processing means carried on the vehicle 10.

In use, two players are carried on each vehicle, one on each seat 16,18. The player in the front seat 16 controls the movement of the vehicle 10 and the player in the rear seat 18 operates the laser source 24. Each vehicle 10 may be assigned to one of a plurality of teams and carry identification (such as its having a body 12 of a particular colour) to indicate to which team it is assigned. During play, the player operating the laser source 24 attempts to direct a laser beam to the detector 32 of a vehicle 10 of an opposing team.

In the event that the detector 32 detects laser light from another vehicle 10, it sends a signal to the data processing means. This causes the sound generating apparatus to generate the sound of a simulated explosion, the vibration generating apparatus to generate vibrations in seats 16,18 and the lights 34 to flash in a distinctive and, preferably, dramatic manner. Additionally, power to the vehicle's motors may be reduced or removed for a period of time.

At the end of a period of play, the data processing means of each vehicle 10 transfers to the computing means data regarding the number of times that laser light generated by an opponent was detected and from this generate a score for each player and for each team.

Additional players may take part in the game using hand held laser sources and detectors carried on their bodies in a manner similar to conventional laser target games.

At least part of the arena has subdued lighting conditions and atmospheric conditions, such as may be created by "stage smoke" apparatus. This allows laser light emitted by the source 24 to be seen by the player operating it to provide that player with visual feedback of his or her actions. The luminous paint allows the vehicles to be seen in such parts of the arena.

Each player may additionally be provided with a safety helmet. Within the helmet there may be an earpiece and a microphone by means of which each player may communicate with the other player on the vehicle and with other players in his or her team.

Whilst an embodiment of the invention has been described, modifications may be made by those skilled in the art without departing from the scope of the invention as defined by the appended claims. For example embodiments are contemplated in which the players sit side-by-side on the vehicle. It is well known in the art to use infra-red detectors and "laser guns" emitting infra-red and laser signals, however, any suitable detector and corresponding signal source may be used.

What is claimed is:

1. Amusement apparatus comprising a vehicle (10) adapted for movement control by a first game player carried on the vehicle (10), the apparatus comprising a signal source (24) carried on the vehicle (10) for emitting a signal and comprising a body shaped to resemble a gun, said signal always being directed in a direction in which said body is pointed, said gun being adapted for control by a second game player also carried on the vehicle and detection means carried on the vehicle, the detection means being operative to detect a signal emitted by a signal source operated by another competing player.

2. Amusement apparatus as claimed in claim 1, wherein the signal source (24) emits, as at least one component of the signal, a visible laser beam.

3. Amusement apparatus as claimed in claim 1, wherein the detection means (32) is arranged on the vehicle such that it is not responsive to signals emitted from sources substantially on a straight ahead axis of the vehicle's direction of travel.

4. Amusement apparatus as claimed in claim 1, further comprising signal detection means adapted to be carried on the body of a player.

5. Amusement apparatus as claimed in claim 1, wherein the vehicle (10) is self-propelled.

6. Amusement apparatus as claimed in claim 5, wherein the vehicle (10) is electrically powered by batteries carried on the vehicle.

* * * * *